US008243550B2

(12) United States Patent
Jeffryes

(10) Patent No.: US 8,243,550 B2
(45) Date of Patent: Aug. 14, 2012

(54) DOWNHOLE COMMUNICATION METHOD AND SYSTEM

(75) Inventor: Benjamin Jeffryes, Histon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 955 days.

(21) Appl. No.: 11/793,462

(22) PCT Filed: Dec. 20, 2005

(86) PCT No.: PCT/GB2005/004963

§ 371 (c)(1),
(2), (4) Date: Aug. 4, 2008

(87) PCT Pub. No.: WO2006/067432

PCT Pub. Date: Jun. 29, 2006

(65) Prior Publication Data

US 2009/0133487 A1 May 28, 2009

(30) Foreign Application Priority Data

Dec. 21, 2004 (GB) ..... 0427908.9

(51) Int. Cl.
*E21B 47/12* (2012.01)

(52) U.S. Cl. ..... 367/82; 340/855.4; 340/855.6; 181/106

(58) Field of Classification Search ..... 367/82; 340/854.3, 855.4, 855.6; 181/106
See application file for complete search history.

(56) References Cited

U.S. PATENT DOCUMENTS

| | | | | |
|---|---|---|---|---|
| 3,106,982 | A | 10/1963 | Wade | |
| 3,914,732 | A | 10/1975 | Brumleve et al. | |
| 4,066,994 | A | 1/1978 | Patchett et al. | |
| 4,293,936 | A * | 10/1981 | Cox et al. | 367/82 |
| 4,367,794 | A | 1/1983 | Bednar et al. | |
| 4,523,651 | A | 6/1985 | Coon et al. | |
| 4,635,238 | A | 1/1987 | Gallagher et al. | |
| 5,293,937 | A | 3/1994 | Schultz et al. | |
| 5,555,220 | A | 9/1996 | Minto | |
| 5,691,712 | A | 11/1997 | Meek et al. | |
| 5,881,310 | A * | 3/1999 | Airhart et al. | 710/3 |
| 5,924,499 | A * | 7/1999 | Birchak et al. | 367/82 |
| 6,023,444 | A * | 2/2000 | Naville et al. | 367/82 |
| 6,094,401 | A * | 7/2000 | Masak et al. | 181/106 |
| 6,195,064 | B1 | 2/2001 | Andrews et al. | |
| 6,308,137 | B1 | 10/2001 | Underhill et al. | |
| 6,320,820 | B1 * | 11/2001 | Gardner et al. | 340/854.4 |
| 6,424,595 | B1 * | 7/2002 | Chenin | 367/82 |
| 6,557,636 | B2 | 5/2003 | Cernocky et al. | |
| 6,584,406 | B1 | 6/2003 | Harmon et al. | |
| 6,885,918 | B2 | 4/2005 | Harmon et al. | |
| 6,985,086 | B2 * | 1/2006 | Tang et al. | 181/106 |
| 7,084,782 | B2 * | 8/2006 | Davies et al. | 340/854.4 |
| 2004/0240320 | A1 * | 12/2004 | McDonald et al. | 367/25 |
| 2006/0114747 | A1 * | 6/2006 | Hentati et al. | 340/855.4 |

FOREIGN PATENT DOCUMENTS

| | | | |
|---|---|---|---|
| EP | 0972909 | A2 | 1/2000 |
| GB | 2321968 | A | 8/1998 |
| GB | 2414494 | A | 11/2005 |
| WO | 98/15850 | A1 | 4/1998 |
| WO | 00/33492 | A1 | 6/2000 |

* cited by examiner

*Primary Examiner* — Frederic L Lagman

(57) ABSTRACT

A system and method is provided for communicating with a device disposed in a wellbore. Signals are sent through the Earth via signal pulses. The pulses are created by a seismic vibrator and processed by a receiver disposed in the wellbore. The receiver is in communication with the device and transfers data, such as command and control signal, to the device.

20 Claims, 5 Drawing Sheets

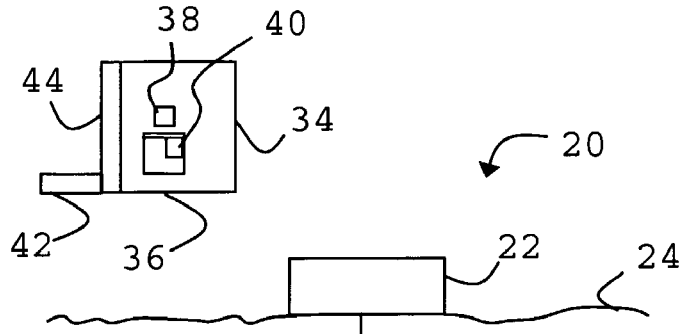
FIG. 1
FIG. 2
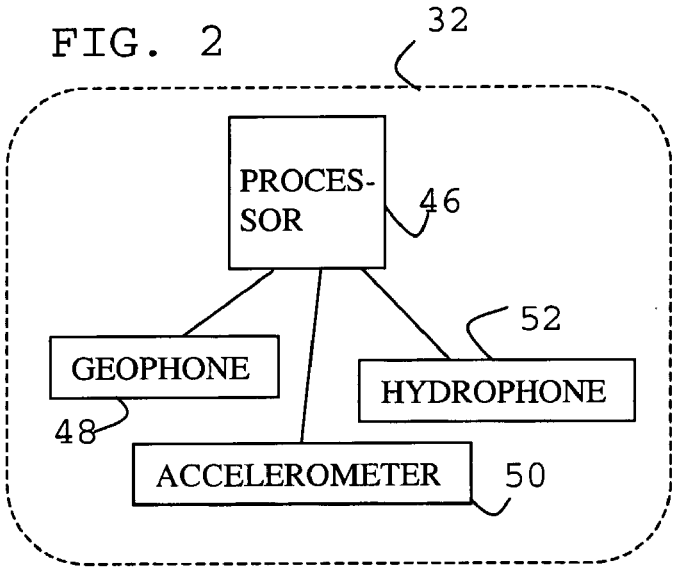
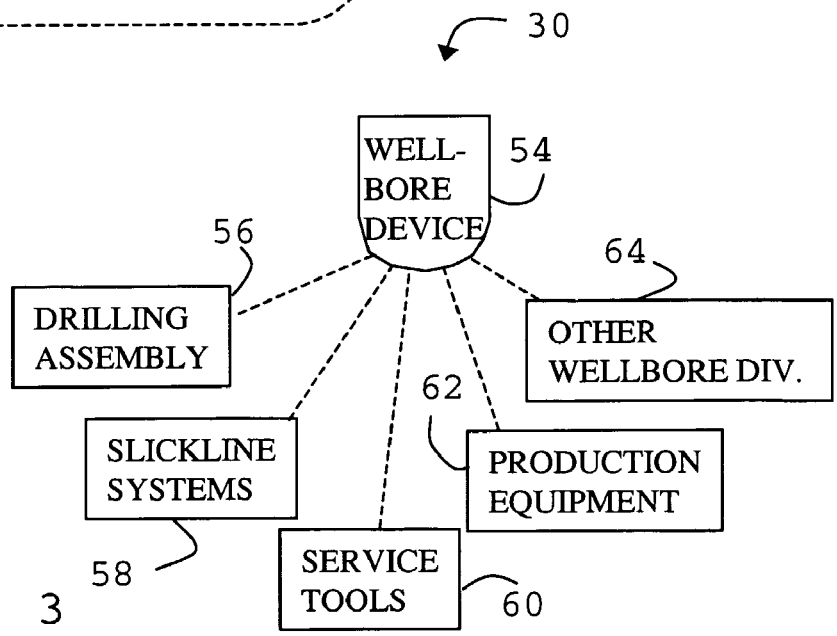
FIG. 3

DOWNHOLE COMMUNICATION METHOD AND SYSTEM

CROSS-REFERENCE TO RELATED APPLICATIONS

This application claims the benefits of priority from:

i) Application Number 0427908.9, entitled "SYSTEM AND METHOD FOR COMMUNICATION BETWEEN A SURFACE LOCATION AND A SUBTERRANEAN LOCATION," filed in the United Kingdom on Dec. 21, 2004; and ii) Application Number PCT/GB2005/004963, entitled "DOWNHOLE COMMUNICATION METHOD AND SYSTEM," filed under the PCT on Dec. 20, 2005;

All of which are commonly assigned to assignee of the present invention and hereby incorporated by reference in their entirety.

BACKGROUND

In a variety of wellbore applications, downhole equipment is used for numerous operations, including drilling of the borehole, operation of a submersible pumping system, testing of the well and well servicing. Current systems often have controllable components that can be operated via command and control signals sent to the system from a surface location. The signals are sent via a dedicated control line, e.g. electric or hydraulic, routed within the wellbore. Such communication systems, however, add expense to the overall system and are susceptible to damage or deterioration in the often hostile wellbore environment. Other attempts have been made to communicate with downhole equipment via pressure pulses sent through the wellbore along the tubing string or through drilling mud disposed within the wellbore.

SUMMARY

In general, the present invention provides a system and method of communication between a surface location and a subterranean, e.g. downhole, location. Signals are sent through the earth using seismic vibrators, and those signals are detected at a signal receiver, typically located proximate the subterranean device to which the communication is being sent. Thus, modulated seismic waves can be used to carry data, such as command and control signals, to a wide variety of equipment utilized at subterranean locations. The preferred frequency range for the seismic waves is in the range 10 Hz to 50 Hz to allow for a significant communication bandwidth whilst attempting to minimize the losses of acoustic energy in the earth.

These and other aspects of the invention are described in the detailed description of the invention below making reference to the following drawing.

BRIEF DESCRIPTION OF THE DRAWINGS

Certain embodiments of the invention will hereafter be described with reference to the accompanying drawings, wherein like reference numerals denote like elements, and:

FIG. 1 is a schematic illustration of a communication system, according to an embodiment of the present invention;

FIG. 2 is a schematic illustration of a receiver utilized with the communication system illustrated in FIG. 1;

FIG. 3 is a schematic illustration of a variety of subterranean devices that can be utilized with the communication system illustrated in FIG. 1;

DETAILED DESCRIPTION

Figure 4:
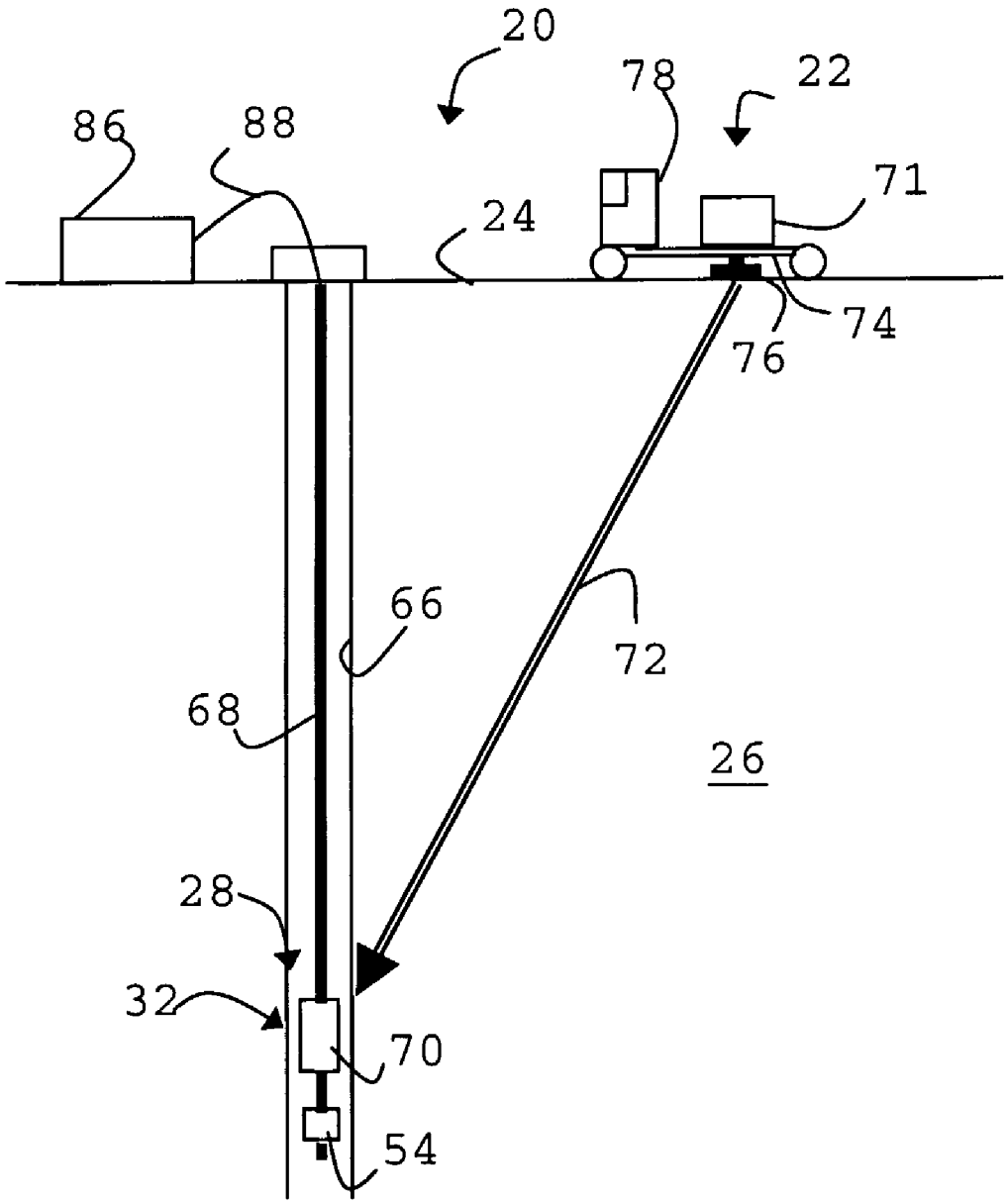
FIG. 4 is a front elevation view of a seismic communication system utilized with downhole equipment deployed in a wellbore, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to communication with subterranean equipment via the use of seismic vibrators. The use of seismic vibrations to communicate data to downhole equipment eliminates the need for control lines or control systems within the wellbore and also enables the sending of signals through a medium external to the wellbore. The present communication system facilitates transmission of data to a variety of tools, such as drilling tools, slickline tools, production systems, service tools and test equipment. For example, in drilling applications the seismic communication technique can be used for formation pressure-while-drilling sequencing, changing measurement-while-drilling telemetry rates and format, controlling rotary steerable systems and reprogramming logging-while-drilling tools. However, the devices and methods of the present invention are not limited to use in the specific applications that are described herein.

Referring generally to FIG. 1, a system 20 is illustrated according to an embodiment of the present invention. In this embodiment, system 20 comprises a transmitter 22 disposed, for example, at a surface 24 of the earth. Transmitter 22 is a seismic vibrator that shakes the earth in a controlled manner and generates low frequency seismic waves in the range of 10 Hz to 50 Hz that travel through a region 26 of the earth to a subterranean system 28. Subterranean system 28 may comprise a variety of components for numerous subterranean applications. To facilitate explanation, however, system 28 is illustrated as having a subterranean device 30 coupled to a receiver 32. Receiver 32 is designed to receive and process the signals transmitted by transmitter 22 so as to supply desired data to subterranean device 30. For example, the transmission may be a command and control signal that causes device 32 undergo a desired action.

Seismic vibrator 22 may be coupled to a control system 34 that enables an operator to control subterranean device 30 via seismic vibrator 22. As illustrated in FIG. 1, control system 34 may comprise a processor 36. The processor 36 comprises a central processing unit ("CPU") 38 coupled to a memory 40, an input device 42 (i.e., a user interface unit), and an output device 44 (i.e., a visual interface unit). The input device 42 may be a keyboard, mouse, voice recognition unit, or any other device capable of receiving instructions. It is through the input device 42 that the operator may provide instructions to seismic vibrator 22 for the transmission of desired signals to receiver 32 and device 30. The output device 44 may be a device, e.g. a monitor that is capable of displaying or presenting data and/or diagrams to the operator. The memory 40 may be a primary memory, such as RAM, a secondary memory, such as a disk drive, a combination of those, as well as other types of memory. Note that the present invention may be implemented in a computer network, using the Internet, or other methods of interconnecting computers. Therefore, the memory 40 may be an independent memory accessed by the network, or a memory associated with one or more of the computers. Likewise, the input device 42 and output device 44 may be associated with any one or more of the computers of the network. Similarly, the system may utilize the capabilities of any one or more of the computers and a central network controller.

Referring to FIG. 2, receiver 32 may comprise a variety of receiver components depending on the methodology selected for transmitting seismic signals through region 26 of the earth. The receiver configuration also may depend on the type of material through which the seismic signal travels, e.g. water or rock formation. In general, receiver 32 comprises a processor 46 coupled to one or more seismic signal detection devices, such as geophones 48, accelerometers 50 and hydrophones 52. By way of example, various combinations of these seismic signal detection devices, arranged to detect seismic vibrations, can be found in vertical seismic profiling (VSP) applications.

In the applications described herein, seismic signals are sent through the earth to provide data, such as command and control signals, to the subterranean device 30. Such signals are useful in a wide variety of applications with many types of subterranean devices, such as a wellbore device 54, as illustrated in FIG. 3. Wellbore device 54 may comprise one or more devices, such as a drilling assembly 56, a slickline system 58, a service tool 60, production equipment 62, such as submersible pumping system components, and other wellbore devices 64.

Referring generally to FIG. 4, one specific example of a wellbore application is illustrated. In this embodiment, wellbore device 54 is disposed within a wellbore 66 on a deployment system 68, such as a tubular, a wire, a cable or other deployment system. Receiver 32 comprises a sensor package 70 containing one or more of the seismic signal detection devices discussed above. Sensor package 70 receives and processes signals received from seismic vibrator/transmitter 22 and provides the appropriate data or control input to wellbore device 54.

In this embodiment, region 26 is primarily a solid formation, such as a rock formation, and seismic signals 72 are transmitted through the solid formation materials from seismic vibrator 22. In this type of application, seismic vibrator 22 is a land vibrator 71 disposed such that the seismic signals 72 travel through the earth external to wellbore 66. Land vibrator 71 comprises, for example, a mass 74 that vibrates against a baseplate 76 to create the desired seismic vibrations. The seismic vibrator may be mounted on a suitable mobile vehicle, such as a truck 78, to facilitate movement from one location to another.

In another embodiment, seismic vibrator 22 is designed to transmit seismic signals 72 through the earth via a primarily marine environment. The signals 72 pass through an earth region 26 that is primarily liquid. For example, wellbore device 54 may be disposed within wellbore 66 formed in a seabed 80. Seismic vibrator 22 comprises a marine vibrator 81 that may be mounted on a marine vehicle 82, such as a platform or ship. By way of example, marine vibrator 81 comprises two hemispherical shells of the type designed to vibrate with respect to one another to create seismic signals 72. Seismic signals 72 are transmitted through the marine environment enroute to seabed 80 and receiver 32.

Figure 5:
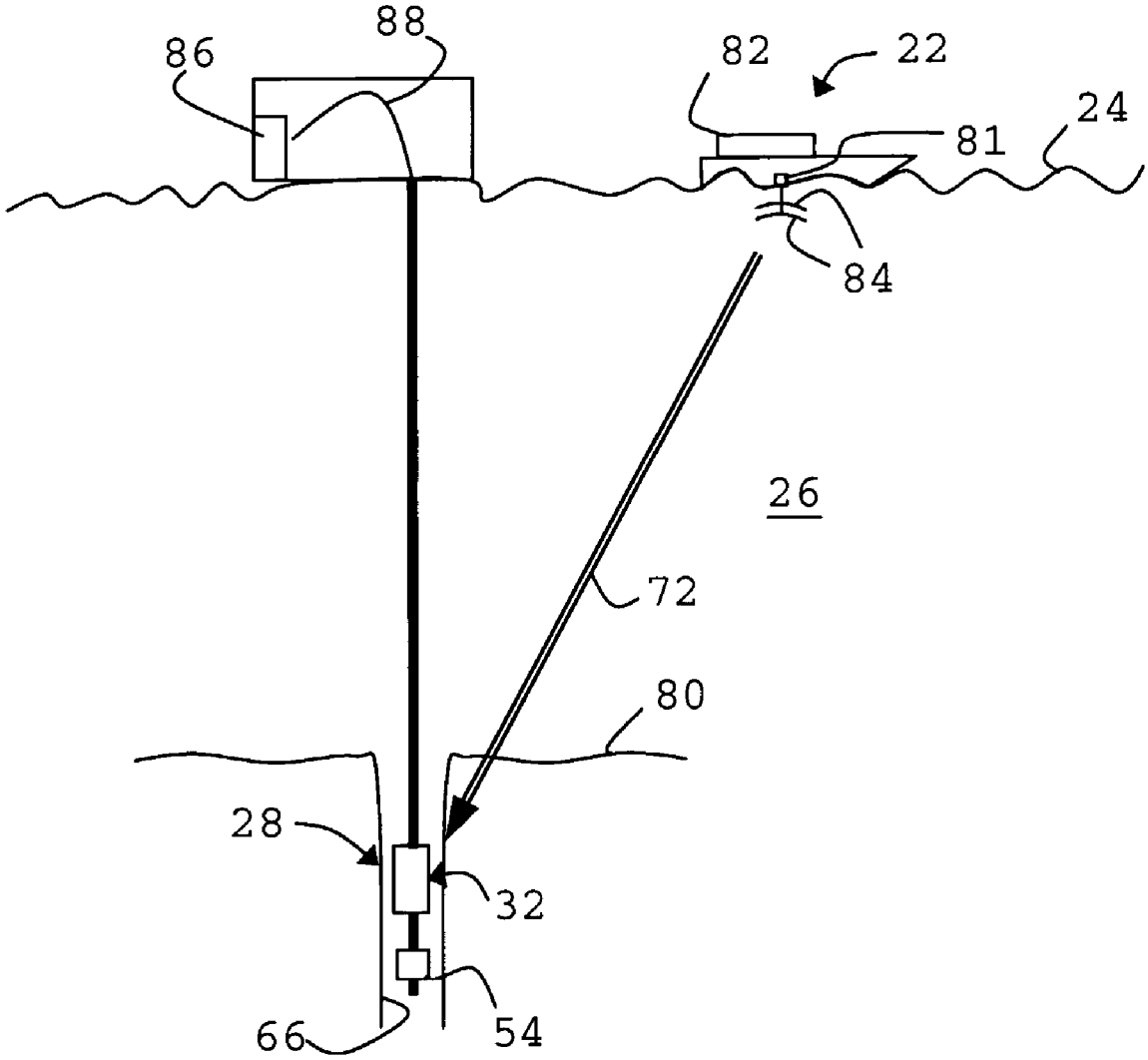
FIG. 5 is a front elevation view of a seismic communication system utilized with downhole equipment deployed in a wellbore, according to another embodiment of the present invention.

In either of the embodiments illustrated in FIG. 4 or FIG. 5, a variety of additional components may be included depending on the specific environment and application. For example, if wellbore device 54 comprises a drilling assembly, a mud pump 86 may be coupled to wellbore 66 via an appropriate conduit 88 to deliver drilling mud into the wellbore. In such example, drilling device 54 may comprise a rotary, steerable drilling assembly that receives commands from seismic vibrator 22 as to direction, speed or other drilling parameters.

Figure 6:
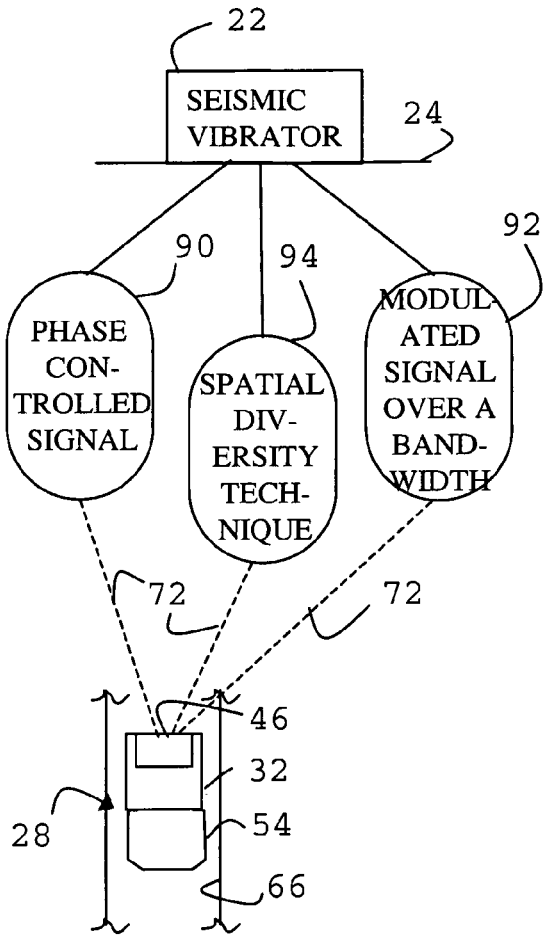
FIG. 6 is a schematic illustration of a transmitter system utilizing various techniques for sending data through the earth via seismic vibrations, according to an embodiment of the present invention.

Seismic vibrator 22 may be operated according to several techniques for generating a signal that can be transmitted through the earth for receipt and processing at subterranean system 28. In general, seismic vibrator 22 is capable of generating a phase-controlled signal 90, as illustrated schematically in FIG. 6. By way of specific example, seismic vibrator 22 is controllable to produce a modulated signal 92. Modulated signals can be designed to initially carry a predetermined introductory signal to begin the transmission and cause receiver 32 to recognize the specific transmission of data. Seismic vibrator 22 can transmit the modulated signal over a bandwidth using a variety of standard methods, as known to those of ordinary skill in the art. In many applications, however, it may be advantageous to restrict the top of the band so that it is less than approximately double the bottom of the band. This helps reduce problems associated with non-linearity. Additionally, a spatial diversity technique 94 can be used to facilitate transmission of the signal from seismic vibrator 22 to subterranean system 28. Spatial diversity techniques may suffer fewer detrimental effects from locally generated noise. These techniques also enable transmission of signals independent of any precision timing of the signals. In other words, there is no need for precision clocking components on either the transmission side or the receiving side.

Figure 7:
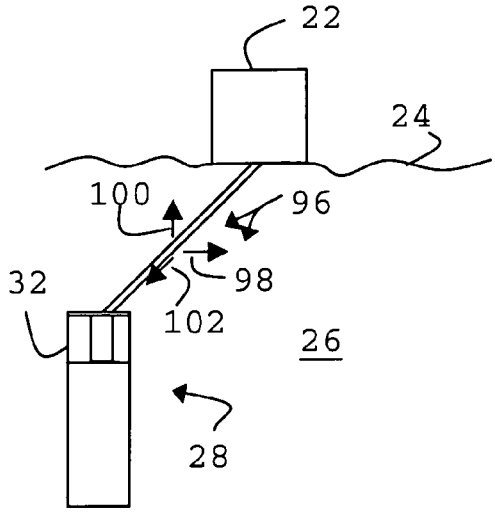
FIG. 7 is a schematic illustration of a technique for seismic communication utilizing spatial diversity demodulation, according to an embodiment of the present invention.

When using the spatial diversity technique 94 for seismic communication through region 26, multiple seismic so signal detection devices are utilized in accomplishing spatial diversity demodulation. This approach is similar to the approach used in certain underwater acoustic and radio communication applications and as described in certain publications, such as U.S. Pat. No. 6,195,064. As illustrated in FIG. 7, spatial diversity utilizes a transmitted signal with a plurality of polarization directions 96. For example, the signals transmitted from seismic vibrator 22 can be illustrated as signals polarized along an x-axis 98, a y-axis 100 and a z-axis 102. With such a technique, there is an improved success rate in transmitting signals from seismic vibrator 22 to downhole system 28, even in adverse conditions, e.g. applications or environments with substantial locally generated noise. This latter technique effectively utilizes a plurality of different field polarizations in combination with the conjugate field, i.e. pressure or vibrational pulses, to achieve the desired seismic communication.

Figure 8:
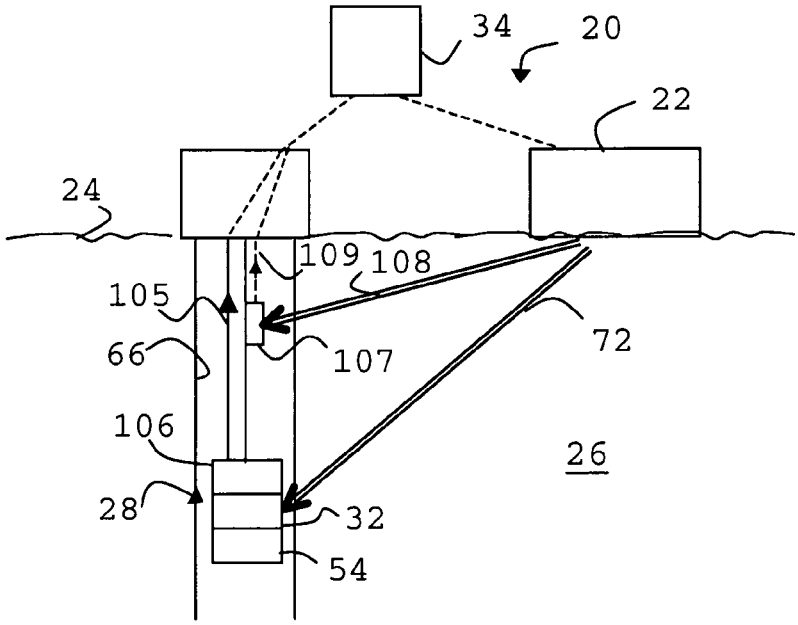
FIG. 8 is a schematic illustration of a system for "uplink" communication between a subsurface transmitter and a receiver/controller disposed at a surface location, according to an embodiment of the present invention.

In another embodiment, system 20 comprises an "uplink" which is a downhole-to-surface telemetry system 104 capable of transmitting a signal 105 from subterranean system 28 to a surface location, as illustrated in FIG. 8. For example, uplink signal 105 can be sent to control system 34 which also can be used to control seismic vibrator 22, as described above. By combining the uplink with a downlink, e.g. the transmission of seismic signals 72, a full duplex system can be achieved.

With the addition of uplink telemetry system 104, seismic signals are sent through the earth external to wellbore 66 for receipt at receiver 32 of subterranean system 28, as previously described. However, an uplink transmitter 106 is communicatively coupled to receiver 32. Transmitter 106 provides appropriate uplink communications related to the seismic signals transferred to receiver 32 and/or to the operation of a component of subterranean system 28, e.g. wellbore device 54. For example, uplink system 104 can be used to send an acknowledgment when the initial predetermined signal of an instruction signal 72 is communicated to receiver 32. The uplink communication confirms receipt of the signals 72, however the lack of an acknowledgment to control system 34 also can be useful. For example, a variety of actions can be taken ranging from ignoring the lack of acknowledgment to switching seismic vibrator 22 to a different frequency band, reducing the bit rate or bandwidth of signals 72 or making other adjustments to signals 72 until subterranean system 28 acknowledges receipt of the instruction.

The specific uplink system 104 used in a given application can vary. For example, uplink communication can be transmitted through a control line within wellbore 66, such as an electric or hydraulic control line. Alternatively, a mud pulse telemetry system can be utilized to send uplink signals 105 through drilling mud, provided the application utilizes drilling mud, as illustrated in the embodiments of FIGS. 4 and 5.

Additionally, the two way communication via downlink signals 72 and uplink signals 105 enable subterranean system 28 to send to the surface location, e.g. control system 34, parameters that describe the transfer function from surface location to the downhole system. This enables the surface system to prefilter the signal reaching the seismic vibrator, thereby improving communication. Furthermore, much of the distortion in a given signal results from near-surface impedance changes that are not significantly altered as a wellbore drilling operation progresses. Accordingly, prefiltering can be established when the downhole receiver is at a shallow depth to facilitate communication at a much greater depth. By way of example, a separate receiver system 107 can be located at a relatively shallow depth. In this embodiment, receiver system 107 comprises one or more components having transmission capability with a high-rate uplink capacity, such as found in a wireline tool. In operation, a seismic signal 108 is received at receiver 107, and an uplink signal 109 is sent to control system 34 to provide information on the seismic signal 108 being received at receiver 107. By prefiltering the signal and otherwise adjusting the vibrator parameters, the signal-to-noise ratio to the shallow receiver system 107 can be increased. These same parameters can then be used to communicate via modified seismic signals 72 with a much deeper receiver, e.g. receiver 32, with which communication tends to be more difficult. Thus, the transmission of seismic signals to a shallow receiver can be used to adjust the parameters of the seismic vibrator 22 to improve the signal and thereby improve transmission to another receiver deeper in the earth. It should be noted that the shallow receiver and the deeper receiver can be the same receiver if initial prefiltering communications are conducted when the receiver is positioned at a shallow depth prior to being run downhole to the deeper location.

By way of example, system 20 can be utilized for transferring many types of data in a variety of applications. In a drilling environment, for example, seismic vibrator 22 can be used to send commands such as: steering commands for a rotary steerable drilling system; instructions on the telemetry rate, modulation scheme and carrier frequency to use for the uplink telemetry; pulse sequences and parameters for nuclear magnetic resonance tools; instructions on which data is to be sent to the surface using the uplink; instructions on operation of a formation pressure probe; firing commands for a downhole bullet and numerous other commands. Many of these commands and applications can be utilized without uplink system 104 or at least without acknowledgment via uplink 105. In a well service environment, seismic signals can be used to transfer data to subterranean system 28. If uplink system 104 is included in overall system 20, the uplink can be used to acknowledge instructions and to transfer a variety of other information to the surface. Examples of command signals that can be sent via system 20 in a well service environment include: setting or unsetting a packer; opening, shutting or adjusting a valve; asking for certain data to be transmitted to surface and numerous other instructions. Of course, the examples set forth in this paragraph are only provided to facilitate understanding on the part of the reader and are not meant to limit the applicability of system 20 to a wide variety of applications, environments and data types.

Figure 9:
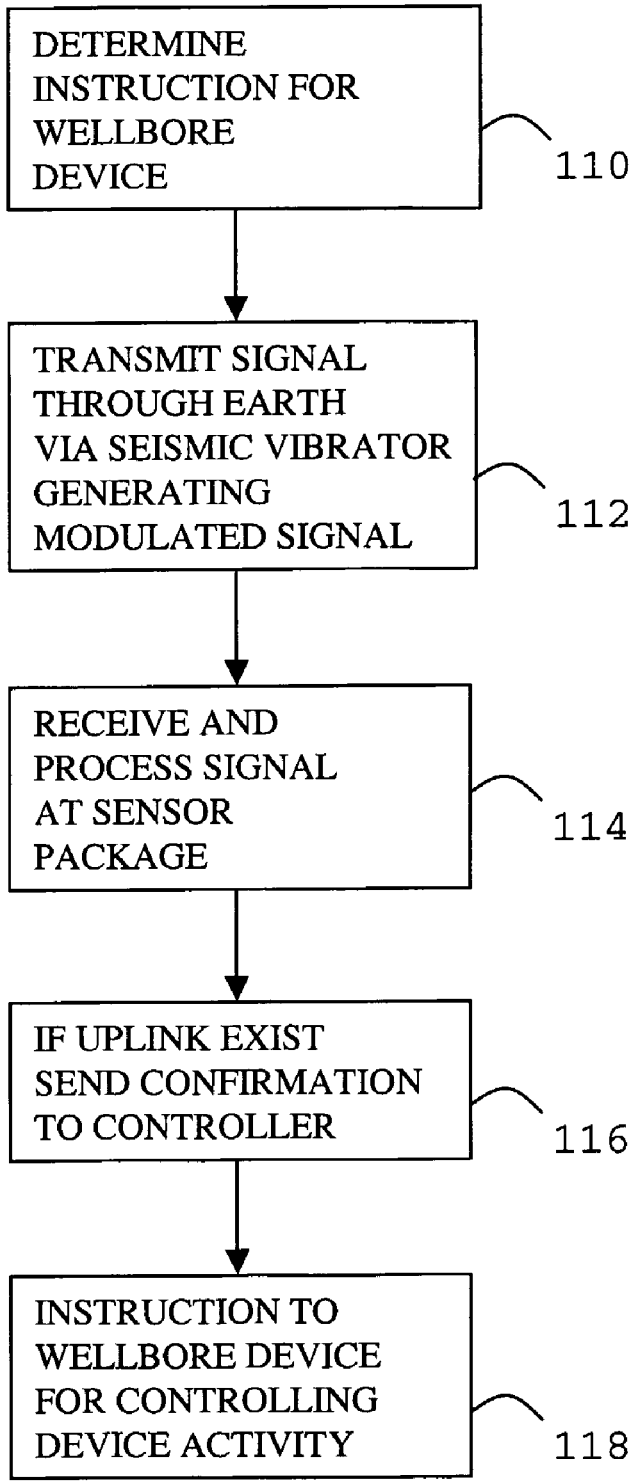
FIG. 9 is a flowchart illustrating an example of operation of a communication system, according to an embodiment of the present invention.

One example of the operation of system 20 is illustrated in flowchart form in FIG. 9. In this example, an initial determination is made as to a desired instruction for wellbore device 54, as illustrated by block 110. An operator can enter the instruction into control system 34 via input device 42 and that input is relayed to seismic vibrator 22 which transmits the seismic signal 72 through the earth, e.g. either a marine environment, a solid formation or a combination of those environments, as illustrated by block 112. The signal is transferred through the earth external to wellbore 66 and received at the sensor package 70 of receiver 32, as illustrated by block 114. If downhole-to-surface system 104 is included as part of system 20, a confirmation is sent to the surface, e.g. to control system 34, as illustrated by block 116. Additionally, data, such as a command instruction, is transferred to wellbore device 54 from receiver 32 to, for example, control a specific activity of the wellbore device, as illustrated in block 118.

The sequence described with reference to FIG. 9 provides an example of the use of system 20 in communicating with a subterranean device. Use of the earth as a medium for transferring seismic signals 72 enables transfer of the signals externally and independently of wellbore 66. However, seismic vibrator 22, downhole receiver 32, the signal transfer technique, e.g. spatial diversity technique, and other potential components of system 20 can be utilized in additional environments and applications with other sequences of operation.

Accordingly, although only a few embodiments of the present invention have been described in detail above, those of ordinary skill in the art will readily appreciate that many modifications are possible without materially to departing from the teachings of this invention. Accordingly, such modifications are intended to be included within the scope of this invention as defined in the claims.

The invention claimed is:

1. A method for communicating data and/or control signals to a device deployed downhole in a wellbore, comprising:

using a seismic source to generate a modulated signal, wherein the modulated signal comprises a predetermined introductory signal and at least one of data and a control signal;

using a receiver to receive the modulated signal at a downhole location, wherein the receiver comprises at least one of a geophone, a hydrophone and an accelerometer, and wherein the receiver is configured to recognize the introductory signal as the beginning of a transmission of the at least one of data and a control signal;

processing the at least one of the data and a control signal in the modulated signal; and transmitting the processed at least one of the data and the control signal to the device.

2. The method of claim 1, wherein the modulated signal has a restricted bandwidth in which a top of the band is less than double a bottom of the band.

3. The method of claim 1, wherein the modulated signal comprises a signal having a plurality of different field polarizations in combination with conjugate field pulses.

4. The method of claim 3, wherein the conjugate field pulses comprise at least one of pressure pulses and vibrational pulses.

5. The method of claim 1, wherein the seismic source comprises one of a seismic land vibrator and a seismic marine vibrator.

6. The method of claim 1, wherein the device comprises one of a drilling assembly, a service tool and a production device.

7. The method of claim 1, wherein the modulated signal comprises a phase controlled signal.

8. The method of claim 1, further comprising:

sending a response signal from the device or the receiver to a surface location.

9. The method of claim 8, wherein the sending of the response signal to the surface acknowledges receipt of the modulated signal by the receiver.

10. The method of claim 8, wherein the response signal is processed at the surface location and operation of the seismic source is modified based upon the processed response signal.

11. The method of claim 1, further comprising:

using the processor to process a modified signal from the received modulated signal; and using a further seismic source to transmit the modified signal.

12. The method of claim 11, wherein the modified signal comprises a modified introductory signal.

13. The method of claim 11, wherein the modified signal comprises at least part of the received modulated signal with an improved signal to noise ratio.

14. A system for communicating data and/or control signals to a device deployed downhole in a wellbore, comprising:

a seismic source configured to generate a modulated signal, wherein the modulated signal comprises a predetermined introductory signal and at least one of data and a control signal;

a receiver configured to receive the modulated signal at a downhole location, wherein the receiver comprises at least one of a geophone, a hydrophone and an accelerometer, and wherein the receiver is configured to recognize the introductory signal as the beginning of a transmission of the at least one of data and a control signal;

a processor configured to process the at least one of the data and a control signal in the modulated signal; and an output for transmitting the processed at least one of the data and the control signal to the device.

15. The system of claim 14, wherein the device comprises a controllable device operatively coupled to the sensor package.

16. The system of claim 14, wherein the device comprises one of a drilling assembly, a service tool and a slickline system.

17. The system of claim 14, wherein the seismic source comprises one of a seismic land vibrator and a seismic marine vibrator.

18. The system of claim 14, further comprising:

a downhole-to-surface telemetry system.

19. The system of claim 14, wherein the modulated signal comprises a phase modulated signal.

20. The system of claim 14, wherein:

the modulated signal comprises a signal having a plurality of different field polarizations in combination with conjugate field pulses; and the processor is configured for spatial diversity demodulation of the modulated signal.

* * * * *